US008567822B2

(12) United States Patent
Lee et al.

(10) Patent No.: US 8,567,822 B2
(45) Date of Patent: Oct. 29, 2013

(54) LUMINOUS ADVERTISEMENT SHEET

(75) Inventors: Taik-Min Lee, Daejeon (KR); Dong-Youn Shin, Daegu (KR); Chung-Hwan Kim, Seoul (KR); Jeong-Dai Jo, Daejeon (KR); Dong-Soo Kim, Daejeon (KR); Byung-Oh Choi, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 565 days.

(21) Appl. No.: 12/598,629

(22) PCT Filed: Dec. 5, 2007

(86) PCT No.: PCT/KR2007/006272

§ 371 (c)(1),
(2), (4) Date: Dec. 21, 2009

(87) PCT Pub. No.: WO2008/136565

PCT Pub. Date: Nov. 13, 2008

(65) Prior Publication Data

US 2010/0133802 A1 Jun. 3, 2010

(30) Foreign Application Priority Data

May 3, 2007 (KR) ..... 10-2007-0043047

(51) Int. Cl.
*B42D 1/00* (2006.01)
*B42D 19/00* (2006.01)
*B42D 15/00* (2006.01)

(52) U.S. Cl.
USPC ..... 283/83; 281/2; 281/3.1; 281/5; 281/15.1; 283/56; 283/61; 283/62; 283/81; 283/85; 283/89; 283/91; 283/94; 283/901

(58) Field of Classification Search
USPC ..... 281/2, 3.1, 5, 15.1; 283/56, 61, 62, 72, 283/81, 83, 85, 89, 91, 94, 901
See application file for complete search history.

(56) References Cited

U.S. PATENT DOCUMENTS

| | | | | |
|---|---|---|---|---|
| 6,977,628 | B1 | 12/2005 | Yaniv | |
| 2008/0148904 | A1 * | 6/2008 | Tomonari et al. | 75/247 |
| 2008/0169639 | A1 * | 7/2008 | Eichenberger | 283/85 |

FOREIGN PATENT DOCUMENTS

| | | |
|---|---|---|
| EP | 1099564 | 5/2001 |
| JP | 08054847 | 2/1996 |

(Continued)

OTHER PUBLICATIONS

International Search Report dated Mar. 4, 2008, issued in PCT/KR2007/006272.

(Continued)

*Primary Examiner* — Dana Ross
*Assistant Examiner* — Justin V Lewis
(74) *Attorney, Agent, or Firm* — Bryan Cave LLP

(57) ABSTRACT

The present invention relates to a luminous advertisement sheet. The luminous advertisement sheet includes a light-transmitting print sheet having an EL advertisement region formed in at least one area of the print sheet, and a general advertisement region formed in the other area thereof. The EL advertisement region has at least one of a fixed pattern portion in which a transparent electrode layer, an EL layer and a dielectric layer are sequentially laminated and a variable pattern portion in which a transparent electrode layer, an EL layer, a dielectric layer and a plurality of pixel electrode layers are sequentially laminated. The general advertisement region allows general dye printing to be performed therein. The luminous advertisement sheet further includes a pattern electrode layer laminated and printed with a conductive ink material to have a predetermined luminous pattern in at least one area of the dielectric layer laminated in the fixed pattern portion and/or the variable pattern portion. Accordingly, there are provided a luminous advertisement sheet that exhibits excellent advertisement effects and can be easily produced in a multi-line small-batch production manner and at remarkably reduced manufacturing costs, and a method of manufacturing the same.

10 Claims, 4 Drawing Sheets

(56) References Cited

FOREIGN PATENT DOCUMENTS

| | | |
|---|---|---|
| JP | 15223144 | 8/2003 |
| KR | 2002607800000 | 1/2002 |
| KR | 1020070026777 | 5/2007 |

OTHER PUBLICATIONS

Written Opinion dated Mar. 4, 2008, issued in PCT/KR2007/006272.
European Search Report dated Feb. 13, 2012, issued in Application No. 07834449.6.

* cited by examiner

LUMINOUS ADVERTISEMENT SHEET

CROSS-REFERENCE TO RELATED APPLICATIONS

The present application is a U.S. National Phase patent application under 35 U.S.C. §371 of International Application No. PCT/KR2007/006272, filed Dec. 5, 2007, which claims priority to South Korean Patent Application No. 10-2007-0043047, filed May 3, 2007, both of which are expressly incorporated herein by reference.

TECHNICAL FIELD

The present invention relates to a luminous advertisement sheet, and more particularly, to a luminous advertisement sheet using an EL (electroluminescence) device.

BACKGROUND ART

In general, in an advertisement sheet such as a banner, a pattern is printed on a target surface to be printed with a general dye ink using a printing technique such as an inkjet or screen printing technique.

However, since a printed pattern is identified on such a conventional advertisement sheet such as a banner by means of only a color or design display effect of the printed pattern, it is not possible to recognize the printed pattern at night. In addition, since the printed pattern is printed as a fixed design, there is a limit on an advertisement effect.

To solve such a problem, a technology for a luminous advertisement using an EL device has been recently disclosed. In the conventional EL luminous advertisement, printed products having an identical printed pattern can be properly mass-produced. However, this is not suitable for a luminous advertisement in which printed products having various printed patterns, which are suitable for multi-line small-batch production, are required to be mass-produced.

Further, in the conventional luminous advertisement using an EL device, it is not possible to actually produce one printed product or a small amount of printed products as required at a home or office in view of its costs.

DISCLOSURE

Technical Problem

Accordingly, an object of the present invention is to provide a luminous advertisement sheet that exhibits excellent advertisement effects and can be easily produced in a multi-line small-batch production manner and at remarkably reduced manufacturing costs, and a method of manufacturing the same.

Technical Solution

According to one aspect of the present invention for achieving the object, there is provided a luminous advertisement sheet including a light-transmitting print sheet having an EL advertisement region formed in at least one area of the print sheet, and a general advertisement region formed in the other area thereof. The EL advertisement region has at least one of a fixed pattern portion in which a transparent electrode layer, an EL layer and a dielectric layer are sequentially laminated and a variable pattern portion in which a transparent electrode layer, an EL layer, a dielectric layer and a plurality of pixel electrode layers are sequentially laminated.

The general advertisement region allows general dye printing to be performed therein. The luminous advertisement sheet further includes a pattern electrode layer laminated and printed with a conductive ink material to have a predetermined luminous pattern in at least one area of the dielectric layer laminated in the fixed pattern portion and/or the variable pattern portion.

In the meantime, according to another aspect of the present invention, there is provided a method of manufacturing a luminous advertisement sheet, comprising the steps of: preparing a light-transmitting print sheet having an EL advertisement region formed in at least one area of the print sheet and a general advertisement region formed in the other area thereof, wherein the EL advertisement region has at least one of a fixed pattern portion in which a transparent electrode layer, an EL layer and a dielectric layer are sequentially laminated and a variable pattern portion in which a transparent electrode layer, an EL layer, a dielectric layer and a plurality of pixel electrode layers are sequentially laminated, and the general advertisement region allows general dye printing to be performed therein; laminating and printing a pattern electrode layer with a conductive ink material to have a predetermined luminous pattern in at least one area of the dielectric layer laminated in the fixed pattern portion and/or the variable pattern portion; and printing a predetermined printed pattern in the general advertisement region using a dye ink.

Preferably, the pattern electrode layer may be formed through an inkjet printing method or a screen printing method.

In addition, the ink material of the pattern electrode layer may be a conductive ink material, and the conductive ink material may be cured at low temperature or contains a UV curable photoinitiator.

At this time, a reinforcement layer made of a resin material may be laminated on the print sheet, and the transparent electrode layer, the EL layer and the dielectric layer may be laminated on the reinforcement layer.

Also, a protective layer made of a resin material may be coated, printed, or laminated on the pattern electrode layer and the pixel electrode layer.

MODE FOR INVENTION

Hereinafter, the present invention will be described in detail with reference to the accompanying drawings.

Figure 1:
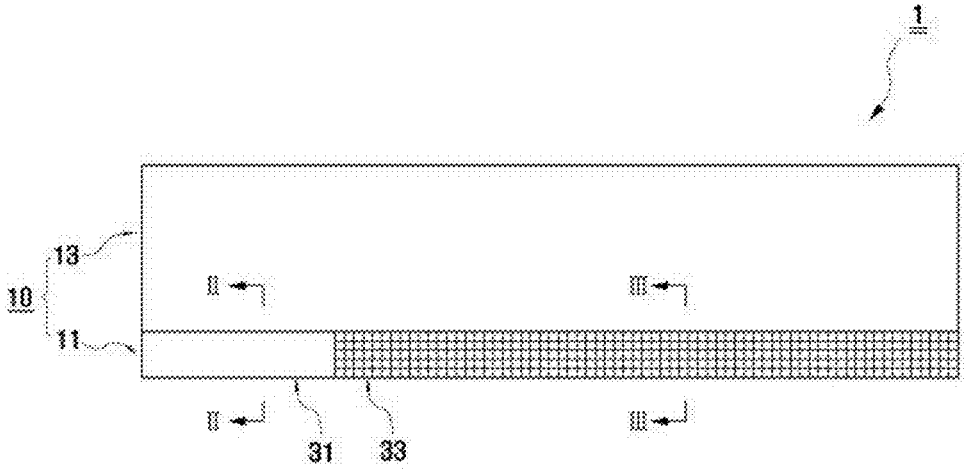
FIG. 1 is a plan view of a print sheet of a luminous advertisement sheet according to the present invention.
Figure 2:
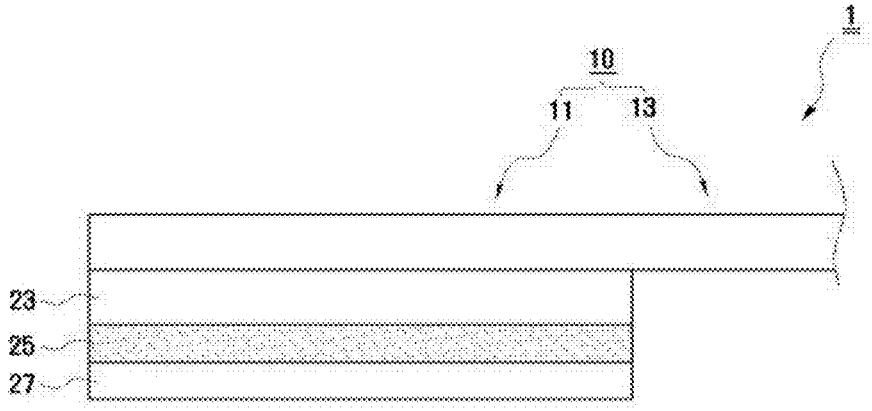
FIG. 2 is a partial sectional view of the print sheet taken along line II-II in FIG. 1.
Figure 3:
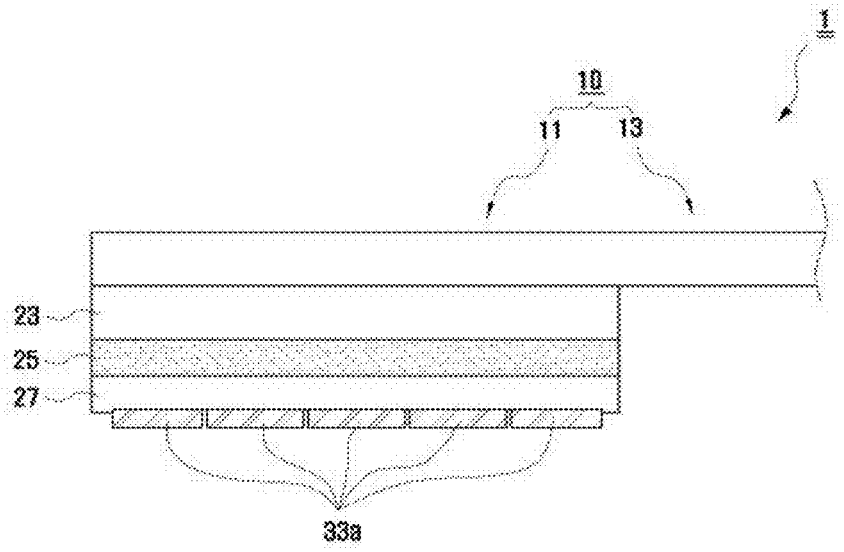
FIG. 3 is a partial sectional view of the print sheet taken along line III-III in FIG. 1.

FIG. 1 is a plan view of a print sheet of a luminous advertisement sheet according to the present invention, FIG. 2 is a partial sectional view of the print sheet taken along line II-II in FIG. 1, and FIG. 3 is a partial sectional view of the print sheet taken along line III-III in FIG. 1.

As shown in these figures, the luminous advertisement sheet 1 according to the present invention includes a print sheet 10 having a general advertisement region 13 and an EL advertisement region 11; variable and fixed pattern portions 33 and 31 formed in the EL advertisement region 11 of the print sheet 10; and a pattern electrode layer (31*a* in FIG. 6) printed in the fixed pattern portion 31 of the EL advertisement region 11.

The print sheet 10 may be formed of various materials such as a print sheet made of paper, a print film made of a resin, a sheet made of fibers, and glass, so far as light can transmit therethrough. The print sheet may be formed of a transparent or translucent material.

The general advertisement region 13 of the print sheet 10 is a region in which a general printed pattern (13*a* in FIG. 6) is printed using a general dye ink. A printed pattern may be directly printed on an upper surface of the print sheet 10 using a general dye. If it is not possible to perform the direct printing, another print sheet for general dye printing may be attached to the print sheet 10, or general dye printing may be performed after a heterogeneous material is coated, printed or laminated on the print sheet.

And, the EL advertisement region 11 of the print sheet 10 is a region in which a luminous pattern based on an EL laminated structure, which will be described later, is formed. The EL advertisement region 11 is prepared in advance by sequentially laminating a transparent electrode layer 23, an EL layer 25 and a dielectric layer 27, which are applied in common to the variable and fixed pattern portions 33 and 31, on a back surface of the print sheet 10.

The transparent electrode layer 23 may be formed of a transparent conductive ink material comprising conductive silver particulates, or a transparent conductive ink material comprising conductive gold, zinc, graphite, copper, ITO, carbon, carbon nano-tubes, conductive polymers, or combinations thereof. A variety of materials may be used so far as they do not depart from the scope and spirit of the present invention.

In this case, the ink material of the transparent electrode layer 23 preferably contains a UV curable photoinitiator suitable for a certain wavelength range so that the transparent electrode layer 23 can be cured by means of a UV curing method at relatively low temperature. It will be apparent that the transparent electrode layer 23 may be cured by means of various curing methods including a natural curing method, a low-temperature curing method and the like so far as the methods do not damage the print sheet 10.

Figure 7:
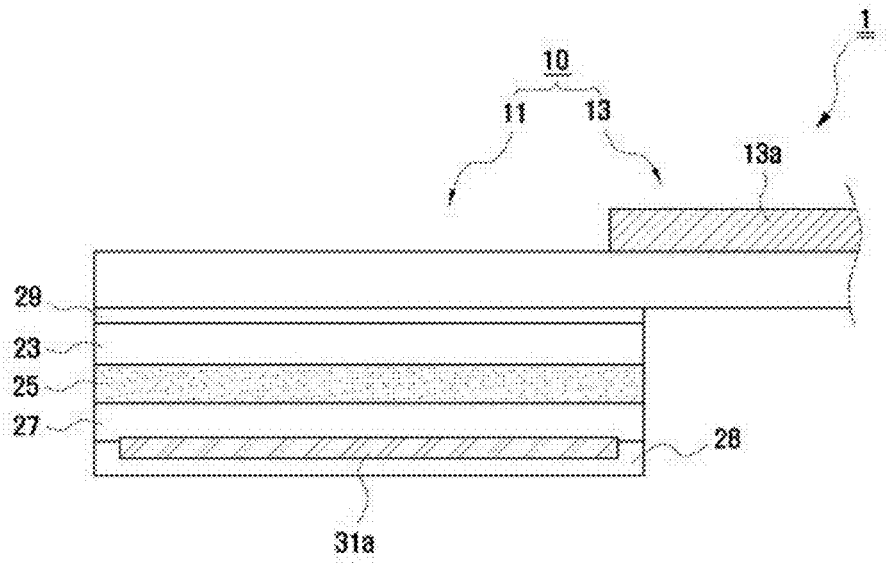
FIG. 7 corresponds to FIG. 6 and is a partial sectional view of another example of the luminous advertisement sheet taken along line VI-VI in FIG. 5.

The transparent electrode layer 23 is electrically connected to an external power source (not shown). Here, as shown in FIG. 7, a reinforcement layer 29 is formed of an insulative resin material between the print sheet 10 and the transparent electrode layer 23, thereby preventing the ink forming the transparent electrode layer 23 from being absorbed into the print sheet 10, and simultaneously reinforcing lamination performance between the print sheet 10 and the ink materials of the transparent electrode layer 23 and the like. In addition, the lamination performance between the print sheet 10 and the ink materials of the transparent electrode layer 23 and the like may be reinforced through plasma treatment, corona treatment, chemical treatment or the like. A substrate with a conductive material coated thereon, such as a transparent film or glass sheet on which ITO has been coated in advance, may be purchased and used for the print sheet 10 and the transparent electrode layer 23.

The EL layer 25 is formed of a luminescence ink material that preferably contains a UV curable photoinitiator suitable for a certain wavelength range, so that the EL layer 25 can be cured by means of a UV curing method at relatively low temperature. It will be apparent that the EL layer 25 may also be cured by means of various curing methods including a natural curing method, a low-temperature curing method and the like so far as the methods do not damage the print sheet 10. The EL layer 25 emits light when electric charges are distributed in the dielectric layer 27 by a current that flows through the transparent electrode layer 23, and the pattern electrode layer (31*a* in FIG. 6) and pixel electrode layers 33*a*, which will be described later.

The dielectric layer 27 may be formed of an ink material comprising barium titanate. The ink material of the dielectric layer 27 preferably contains a UV curable photoinitiator suitable for a certain wavelength range, so that the dielectric layer 27 can be cured by means of a UV curing method at relatively low temperature. It will be apparent that the dielectric layer 27 may also be cured by means of various curing methods including a natural curing method, a low-temperature curing method and the like so far as the methods do not damage the print sheet 10.

Further, it will be apparent that a variety of ink materials, which include barium titanate and serve as dielectrics so far as they do not depart from the scope and spirit of the present invention, can also be used for the material of the dielectric layer 27. Electric charges are distributed in the dielectric layer 27 when a current flows through the transparent electrode layer 23, and the pattern electrode layer (31*a* in FIG. 6) and the pixel electrode layers 33*a*, which will be described later.

Meanwhile, the EL advertisement region 11 is appropriately divided into the variable and fixed pattern portions 33 and 31. When the variable pattern portion 33 is formed by laminating and printing the plurality of pixel electrode layers 33*a* on the dielectric layer 27 at one divided side of the EL advertisement region 11, the fixed pattern portion 31 that is an area with the pattern electrode layer 31*a* laminated and printed therein is formed at the other divided side of the EL advertisement region 11. Here, power may be independently supplied to the respective pixel electrode layer 33*a*.

Figure 4:
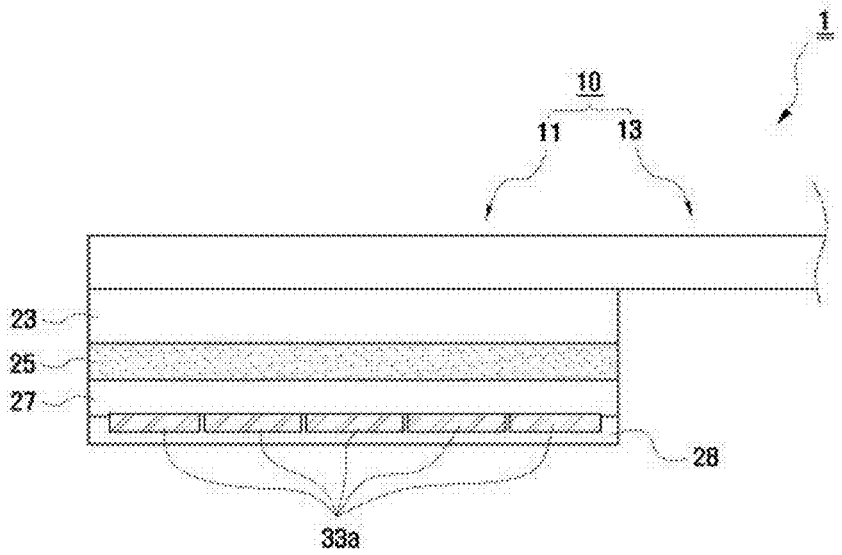
FIG. 4 is a partial sectional view of another example of the print sheet taken along line III-III in FIG. 1.

As shown in FIG. 4, a protective layer 28 made of a transparent resin material can be laminated on outer surfaces (lower surfaces in this figure) of the pattern electrode layer 31*a* and the pixel electrode layers 33 to protect the pixel electrode layers 33*a* and the like. Although not shown in the figure, bus electrodes (not shown) to be connected to an external power source may be additionally printed on the transparent electrode layer 23 and the pixel electrode layers 33*a* for supplying electric power.

Here, it will be apparent that both the variable and fixed pattern portions 33 and 31 may be provided on the print sheet 10, or only one of the variable and fixed pattern portions 33 and 31 may be provided on the print sheet 10.

Accordingly, an original member of the print sheet 10 having the general advertisement region 13 in which general printing can be made using a general dye ink, the variable pattern portion 33 formed by the plurality of pixel electrode layers 33*a*, and the fixed pattern portion 31 in which the pattern electrode layer 31*a* to be described later will be printed is provided.

The print sheet 10 is manufactured in advance. A user purchases the print sheet 10, and can print a pattern on the general advertisement region 13 by means of general dye printing and implement variable patterns such as a variety of desired characters, symbols and images, which are changeable with time, in the variable pattern portion 33 by using an additional controller.

Figure 5:
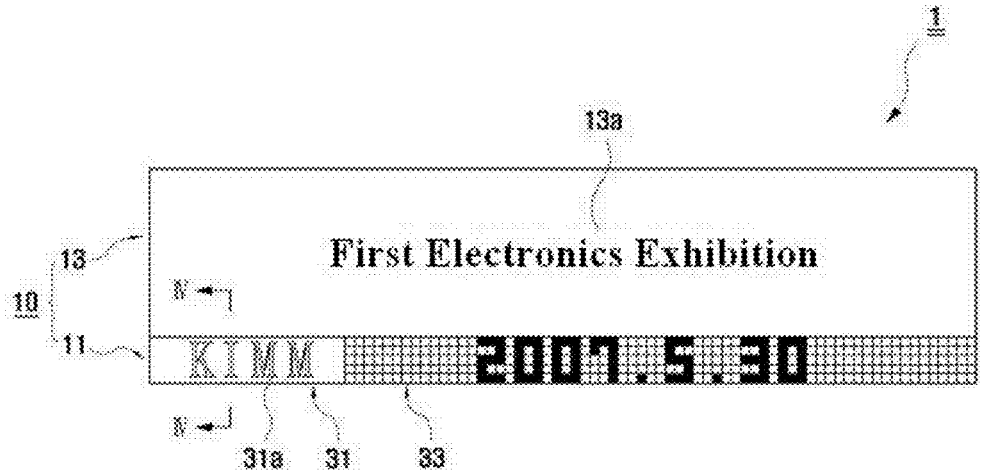
FIG. 5 is a plan view showing a completed state of a luminous advertisement sheet according to the present invention.
Figure 6:
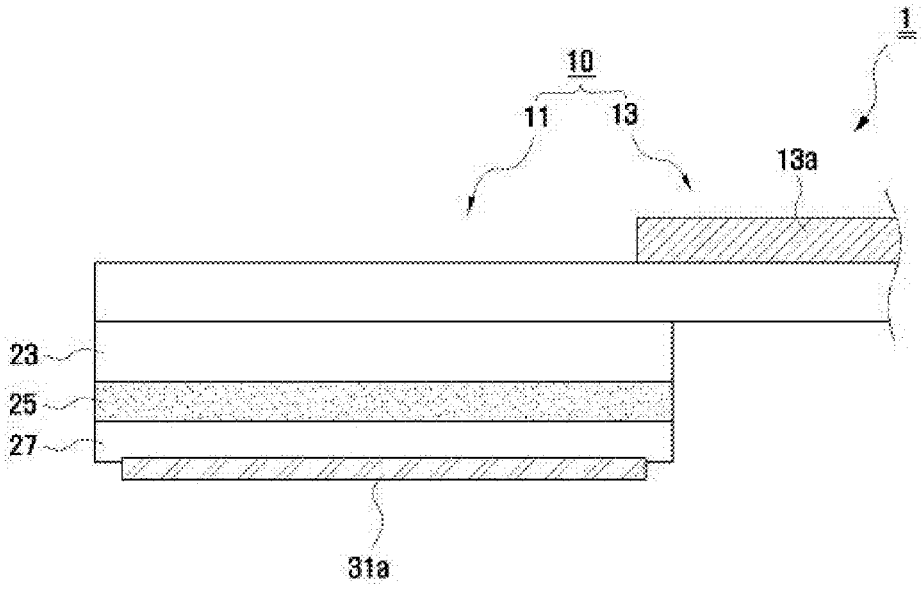
FIG. 6 is a partial sectional view of the luminous advertisement sheet taken along line VI-VI in FIG. 5.

Meanwhile, as shown in FIGS. 5 and 6, the pattern electrode layer 31*a* is formed by printing a variety of desired characters, symbols, images and the like on the back surface of the dielectric layer 27 (the lower surface of the dielectric layer 27 in these figures) in the fixed pattern portion 31 of the original member of the print sheet 10 by using an ink material made of a conductive material.

The pattern electrode layer 31*a* may be printed with a conductive ink material comprising conductive silver particulates, or a conductive ink material comprising conductive gold, zinc, graphite, copper, ITO, carbon, carbon nano-tubes, or combinations thereof.

In this case, the pattern electrode layer 31*a* is preferably laminated and printed using a direct or digital printing method such as an inkjet printing method. Alternatively, the pattern electrode layer 31*a* may be laminated and printed using a relatively easy printing method such as screen printing.

The ink material used for the pattern electrode layer 31*a* also preferably contains a UV curable photoinitiator suitable for a certain wavelength range, so that the pattern electrode layer 31*a* can be cured by means of a low-temperature UV curing method and a thermal curing method at relatively high temperature. It will be apparent that the pattern electrode layer 31*a* may be cured without the UV photoinitiator. The pattern electrode layer 31*a* is electrically connected to an external power source (not shown).

In this case, as shown in FIG. 7, the protective layer 28 made of a transparent resin material is laminated on the outer surface (the lower surface in this figure) of the pattern electrode layer 31*a* to protect the pattern electrode layer 31*a* and the like. Although not shown in the figure, bus electrodes (not shown) to be connected to the external power source may be additionally printed on the transparent electrode layer 23 and the pattern electrode layer 31*a* for supplying the electric power.

Next, a method of manufacturing a luminous advertisement sheet 1 with the aforementioned structure according to the present invention will be described.

Figure 8:
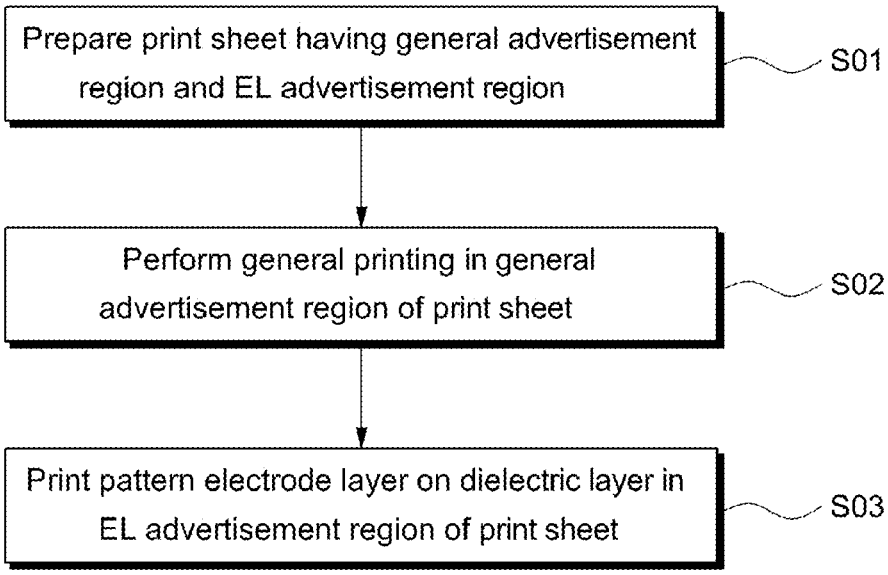
FIG. 8 is a flowchart illustrating a method of manufacturing a luminous advertisement sheet according to the present invention.

As shown in FIG. 8, the method of manufacturing the luminous advertisement sheet 1 according to the present invention comprises the steps of: preparing the print sheet 10 having the general advertisement region 13 and the EL advertisement region 11 (step S01), performing general printing in the general advertisement region 13 of the print sheet 10 (step S02), and printing the pattern electrode layer 31*a* on the dielectric layer 27 of the fixed pattern portion 31 in the EL advertisement region 11 (step S03).

The step (step S01) of preparing the print sheet 10 is the step of preparing the print sheet 10 in which the general advertisement region 13 and the EL advertisement region 11 have been formed. As described above, the transparent electrode layer 23, the EL layer 25 and the dielectric layer 27 are sequentially laminated in the EL advertisement region 11, and the pixel electrode layers 33*a* are formed in a variable pattern portion 33. The print sheet 10 is manufactured in advance. An original version of the print sheet 10 may be used as it is, or may be appropriately cut to a size suitable for the luminous advertisement sheet 1.

The step (step S02) of performing general printing in the general advertisement region 13 of the print sheet 10 is the step of printing the general printed pattern (13*a* in FIGS. 5 and 6) in a desired shape using a general dye ink by means of a certain printing technique. A method of printing the advertisement sheet 1 such as a general banner may be used in this step.

On the other hand, the step (step S03) of printing the pattern electrode layer 31*a* on the dielectric layer 27 of the fixed pattern portion 31 is the step of laminating and printing the pattern electrode layer 31*a* as a predetermined printed pattern on the dielectric layer 27 corresponding to the fixed pattern portion 31 of the print sheet 10 using a printing technique such as an inkjet or screen printing technique and subsequently curing the pattern electrode layer.

In the luminous advertisement sheet 1 manufactured through such processes according to the present invention, when a current flows by supplying power to the transparent electrode layer 23, the pixel pattern 33 and the pattern electrode layer 31*a*, electric charges are distributed in the dielectric layer 27 and regions of the EL layer 25 corresponding to the pixel electrode layers 33*a* and the pattern electrode layer 31*a* can emit light.

Light emitted from the EL layer 25 is radiated to the outside through the light-transmitting print sheet 10 while maintaining the pattern shapes of the corresponding pixel electrode layers 33*a* and the pattern electrode layer 31*a*, so that an observer can view the luminous printed pattern emitting the light with the naked eyes.

At this time, the fixed pattern portion 31 has a luminous fixed pattern corresponding to a symbol, an image or the like, and the variable pattern portion 33 has a luminous desired character, symbol or simple moving image, which is changed every moment using a controller (not shown), thereby exhibiting various visual effects.

In addition, a visual effect corresponding to that of a general advertisement sheet such as a banner can be obtained from the general advertisement region 13 of the print sheet 10 using a general dye.

As described above, a general printed pattern, a luminous fixed printed pattern and a luminous variable printed pattern can be expressed in the luminous advertisement sheet according to the present invention, thereby maximizing visual advertisement effects.

Further, since an original member of the print sheet can be mass-produced in a simple manner, a user can purchase the original version of the print sheet and then perform general printing and printing of the pattern electrode layer in desired shapes, thereby properly mass-producing a printed product having a variety of luminous patterns and a general printing pattern.

Furthermore, a user can purchase one print sheet or a small amount of print sheets and then very easily make a luminous advertisement sheet or sheets such as banners at low costs at a small office or the like.

The scope of the present invention is not limited to the embodiments described above and the scope of the present invention is determined and defined only by the appended claims. Further, those skilled in the art can make various changes and modifications thereto without departing from its true spirit. Therefore, various changes and modifications obvious to those skilled in the art will fall within the scope of the present invention.

What is claimed is:

1. A luminous advertisement sheet, comprising:

a light-transmitting print sheet having an electroluminescence advertisement region, formed in some area thereof, and a general advertisement region, formed in the other area thereof, the electroluminescence advertisement region having at least one of a fixed pattern portion, in which a transparent electrode layer, an electroluminescence layer, a dielectric layer are sequentially laminated and a variable pattern portion, in which a transparent electrode layer, an electroluminescence layer, a dielectric layer and a plurality of pixel electrode layers are sequentially laminated, the general advertisement region allowing general dye printing to be performed therein, and a pattern electrode layer laminated and printed with a conductive ink material to have a predetermined luminous pattern in some area of the dielectric layer laminated in the fixed pattern portion, wherein light emitted from the electroluminescence layer is radiated to the outside through the light-transmitting print sheet, and the electroluminescence layer is formed in common on the variable and fixed pattern portions on a back surface of the light-transmitting print sheet, and wherein power is independently supplied to the respective pixel electrode layer of the variable pattern portion, and variable patterns are implemented in the variable pattern portion.

2. The luminous advertisement sheet as claimed in claim 1, wherein the pattern electrode layer is formed through an inkjet printing method or a screen printing method.

3. The luminous advertisement sheet as claimed in claim 1, wherein the pattern electrode layer is formed from a conductive ink material which is cured at low temperature or contains a UV curable photoinitiator.

4. The luminous advertisement sheet as claimed in claim 1, further comprising a reinforcement layer made of a resin material and formed between the print sheet and the transparent electrode layer.

5. The luminous advertisement sheet as claimed in claim 1, further comprising a protective layer made of a resin material and formed on the pattern electrode layer and the pixel electrode layers.

6. A method of manufacturing a luminous advertisement sheet, comprising the steps of:

preparing a light-transmitting print sheet having an electroluminescence advertisement region formed in some area of the print sheet and a general advertisement region formed in the other area thereof, the electroluminescence advertisement region having at least one fixed pattern portion in which a transparent electrode layer, an electroluminescence layer and a dielectric layer are sequentially laminated and a variable pattern portion in which a transparent electrode layer, an electroluminescence layer, a dielectric layer and a plurality of pixel electrode layers are sequentially laminated, the general advertisement region allowing general dye printing to be performed therein, laminating and printing a pattern electrode layer with a conductive ink material to have a predetermined luminous pattern in at least one area of the dielectric layer laminated in the fixed pattern portion and/or the variable pattern portion, and printing a predetermined printed pattern in the general advertisement region using a dye ink, wherein light emitted from the electroluminescence layer is radiated to the outside through the light-transmitting print sheet, and the electroluminescence layer is formed in common on the variable and fixed pattern portions on a back surface of the light-transmitting print sheet, and wherein power is independently supplied to the respective pixel electrode layer of the variable pattern portion, and variable patterns are implemented in the variable pattern portion.

7. The method as claimed in claim 6, wherein the pattern electrode layer is formed through any one of an inkjet printing method and a screen printing method.

8. The method as claimed in claim 6, wherein the pattern electrode layer is formed from a conductive ink material which is cured at low temperature or contains a UV curable photoinitiator.

9. The method as claimed in claim 6, wherein the light-transmitting print sheet comprises a reinforcement layer made of a resin material and laminated thereon, and the transparent electrode layer, the electroluminescence layer and the dielectric layer are laminated on the reinforcement layer.

10. The method as claimed in claim 6, wherein a protective layer made of a resin material is coated, printed, or laminated on the pattern electrode layer and the pixel electrode layers.

* * * * *